United States Patent [19]

Fotland et al.

[11] Patent Number: 4,920,039

[45] Date of Patent: Apr. 24, 1990

[54] MULTIPLE IMAGING

[75] Inventors: Richard A. Fotland, Holliston; Gary V. Grosclaude, Wayland, both of Mass.; Richard L. Briere, decesased, late of Hopkinton, Mass., by Eleanor L. Briere, Administrator

[73] Assignee: Dennison Manufacturing Company, Framingham, Mass.

[21] Appl. No.: 280,373

[22] Filed: Dec. 6, 1988

Related U.S. Application Data

[63] Continuation-in-part of Ser. No. 225,505, Jul. 28, 1988, which is a continuation of Ser. No. 816,497, Jan. 6, 1986, abandoned.

[51] Int. Cl.[5] ..... G03C 5/16

[52] U.S. Cl. ..... 430/324; 430/321; 430/394; 430/396; 430/946; 350/167

[58] Field of Search ..... 430/14, 15, 18, 321, 430/324, 325, 322, 394, 396, 946, 7, 295; 350/128, 167; 354/101

[56] References Cited

U.S. PATENT DOCUMENTS 3,284,208 11/1966 Land ..... 430/7

3,617,281 11/1971 Lindin ..... 430/396 X

*Primary Examiner*—Jose Dees

*Attorney, Agent, or Firm*—Barry D. Josephs

[57] ABSTRACT

A method and article providing different images from differing viewing angles. The image side of a lenticular sheet is printed with radiation sensitive image layer and cured using a collimated radiation source located at a viewer position with respect to the lenticular surface. Uncured imaging material is removed from the printed surface as by rinsing, and the resulting clear region of the imaging surface may be processed further in a variety of ways. The clear region may be left unprinted, or printed with a second image different from the first, or printed with a stereoscopic image that combines with its pre-printed mate to form a three dimensional image. The clear region also may be vacuum metallized or chemically plated to form a highly reflective surface. The method permits use of relatively thin lenticular sheeting.

10 Claims, 2 Drawing Sheets

MULTIPLE IMAGING

This application is a continuation-in-part of patent application Ser. No. 225,5505, filed July 28, 1988 pending which was a continuation of application Ser. No. 816,497 filed Jan. 6, 1986 (abandoned).

BACKGROUND OF THE INVENTION

The present invention relates to multiple imaging, and more particularly to an improved method for producing multiple-image media and to media produced by such method.

The production of images which change with a change in viewing angle has been known for many years. Such technology is described, for example, in G. Anderson, U.S. Pat. No. 2,815,310. The images are produced on opaque or transparent sheets of material such as paper, paperboard or plastic. The resulting imprint, in black and white or color, is laminated to a transparent lenticular lense. Alternatively, a transparent plastic carrier may be printed on the reverse side and viewed through a lenticular lense face of the carrier.

A lenticular screen, as is well known, has a number of lenses arranged in a side-by-side relationship on one face. Each lense, commonly termed a lenticle, may be formed by an elongated or circular convex frontal surface, and a flat rear surface.

The printed image is formed by two interleave pictures producing a grid or parallel lines with alternating striations. The pitch, or number of picture element pairs per unit distance, is the same as the lense pitch of the lenticular array. The focal lense of each of the lenticles should be equal to the thickness of the lenticular sheet. Under these conditions, at one viewing angle an observer will see only one picture, while at a different angle the same observer will see the other picture.

The requirement that the picture elements be in registration with the lenticular array complicates the printing and lense forming steps. In practice, the pitch of the lenticular assembly is limited to a spacing that is equivalent to 100 lenticles per inch, or less. Even with 50–100 lenticles per inch, it is difficult to hold the registration over widths of more than a few inches. This limitation restricts the image resolution, as well as size.

U.S. Pat. No. 3,284,208 to Land discloses a photomechanical printing method and apparatus for forming color screen elements using lenticular media. In the Land method, at a first stage a "photo-responsive layer" such as potassium, sodium or ammonium dichromate sensitized gelatin, is laid down on the flat side of the lenticular sheet. The gelatin is then irradiated with radiation (such as ultraviolent radiation) which is actinic to the photo-responsive layer. The element is contacted with water or other suitable solvent to remove unexposed portions of the photo-responsive layer, and the element then contacted with a dye solution substantive to the remaining portions of the photo-responsive layer to provide optical filter elements. The layer is then coated with an adhesive layer for protection; after such layer dries, the process may be repeated.

U.S. Pat. No. 3,617,281 to Lindin discloses a system for printing lenticular films using collimated light, according to the Land process.

Commonly assigned copending U.S. Pat. Application No. Ser. No. 225,505 discloses a method for imprinting of lenticular films, and improved films made by such method. The flat face of a lenticular film disclosed therein (having an array of lenticles on the opposite face) is imprinted with a visible light absorbing ultraviolet radiation sensitive imaging layer which is irradiated with collimated light through the lenticular sheet to render portions of the layer insoluble to a predetermined solvent. The layer is then washed with such solvent to remove the still-soluble solvent thereof. This method has two major advantages over that of the Land and Lindin patents, i.e., it eliminates the need to subsequently imbibe a photo-responsive layer with a separate dye or other color material, since the imaging layer itself contains the visible light absorping materials. This permits, e.g., the imprinting of an arbitrary multi-color pattern and the subsequent selective removal of the pattern. Furthermore, applicant's prior art method eliminates the need for the adhesive (protective) layer. These two process differences result in a simpler, less expensive, and more rapid process.

SUMMARY OF THE INVENTION

In accomplishing the foregoing and related objects, the invention provides a method of forming an article with multiple images by providing a lenticular sheet and using the sheet to generate self-contained striated images. The lenticular sheet is formed preferably of a relatively thin thermoplastic sheet having rows of lenticles (lens) embossed on one side of the sheet. For that purpose the lenticular sheet is provided with an image layer desirably on a flat surface. The sheet is then subjected to collimated radiation to form bands or striations in the image layer, which is advantageously formed of a radiation curable ink.

The image layer is created by applying a radiation cross-linkable visible light absorbing U.V. sensitive coating in any desired pattern, to the side opposite the rows of lenticles on the lenticular sheet. The image layer is formed of a cross-linkable polymer which undergoes a chemical change upon exposure to collimated radiation from an ultraviolet light source. This chemical change or curing causes the image layer to become insoluble and have greater adhesion to the lenticular sheet in those regions or rows wherein it was exposed to the collimated radiation. The unexposed portions of the image are then simply rinsed away with water leaving an image of high clarity when viewed through the lenticle side of the sheet. The present invention has an added advantage in that it obviates any need to add dyes or other light absorbing material to be absorbed into the imaging layer at any time after it has been coated onto the lenticular sheet, since the imaging layer itself contains a visible light absorbing pigment.

In accordance with one aspect of the invention the image layer may be multicolored, line, half-tone, and printed by any of a variety of processes including silk-screened, gravure, flexo or planographic.

In accordance with another aspect of the invention the lens array of the sheet focuses radiation from a source and the image layer is cured in bands or striation. The uncured areas are then dissolved or rinsed away as aforementioned, leaving a permanent striation pattern. An advantage of the present invention is that the unexposed i.e., the uncured portions of the ink, may be rinsed away using water.

In accordance with a further aspect of the invention, a second image can be printed on the image surface of the array. Where the image surface contains only one set of straited images, a particular image is seen. Where the regions without image are transparent, the interior contents of an associated package may be seen from the viewing angle associated with those regions.

In accordance with yet another aspect of the invention, a three-dimensional image is realized and alternate images are produced on the imaging surface of the lenticular lens array in stereoscopic pairs. An eye at one position sees a first image while the other eye sees another image. The combination of the two images produces a stereoscopic effect. The radiation curable coating is advantageously on a flat surface of the sheeting and opposite the lenticles. It is desirable for the coating to be curable by ultraviolet radiation, with the uncured material rinsed to leave regions of the imaging side of the array devoid of coating as aforementioned. The lenticular sheet, with its cured striated coating, can be used in packaging such that an image is seen from one viewing angle and another image, if desired, may be seen from another viewing angle. The present invention also permits the interior of the package to be visible from another viewing angle.

It has been found desirable to employ relatively thin lenticular sheets. The sheet is preferably of a thermoplastic material and of thickness preferably less than about 10 mil, typically between about 2 and 6 mil. The lenticle density i.e., the number of lenticle rows per inch is advantageously high preferably greater than 100 lenticles (or grooves) per inch and advantageously between 200 and 600 lenticles per inch, typically between about 250 to 450 lenticles per inch. The present invention is not intended to be limited to the high lenticle density but it has been determined that the higher lenticle density on relatively thin sheeting produces images of higher clarity. The use of a photosensitive image layer in the present method which permits rinsing of unexposed, uncured portions has permitted use of high density lenticles on relatively thin sheeting.

The preferred image layer which becomes insoluble upon exposure to collimated radiation is composed principally of a binder system, a water-dispersable pigment and a photosensitive component. The photosensitive component is preferably a light sensitive diazo resin such as polymethylene para diazo diphenylamine sulfate salt. The binder system is advantageously composed of a water soluble polymer and an aqueous dispersion. The water soluble polymer is preferably polyvinyl alcohol or hydroxyethyl cellulose. The acqueous dispersion is typically a modified polyvinyl acetate emulsion.

By the present invention, the requirement for image registration with the lenticular array is also completely eliminated. An important advantage of the present invention is, therefore, cost reduction through the elimination of the expensive registration requirements. Another advantage of the invention therefore is the attainment of higher resolution, and hence higher quality images than when registration is used.

Yet another advantage of the invention is cost reduction by using thinner plastic sheeting. The focal length of the lenticular array and the thickness of the sheet are related. By employing greater than 100 lenticle rows per inch, the thickness of a plastic lenticular sheet can be reduced by a factor of as much as two or three.

DESCRIPTION OF THE DRAWINGS

Other aspects of the invention will be apparent after considering several illustrative embodiments, taken with the drawings in which.

DETAILED DESCRIPTION

Figure 1:
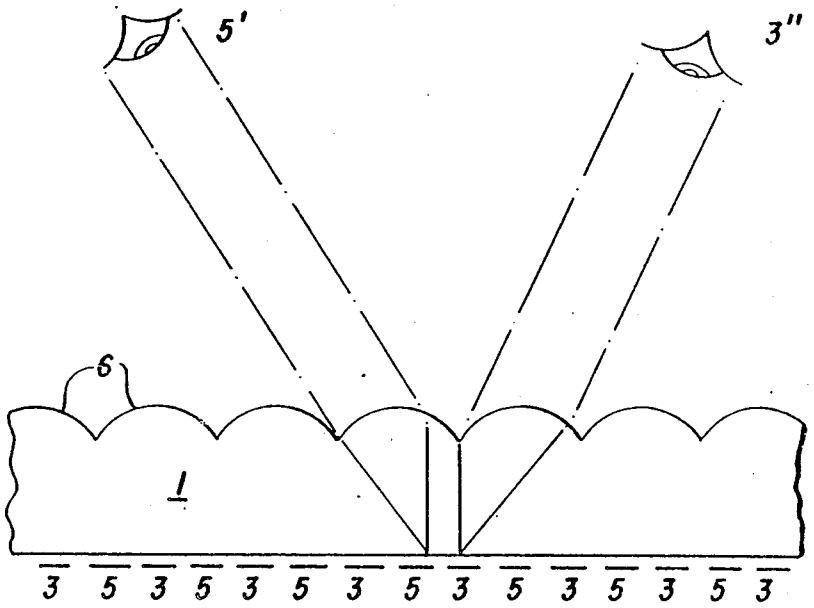
FIG. 1 is a cross-sectional view of a multiple imaging embodiment.

With reference to the drawings, FIG. 1 shows an element 1 for the viewing of different lenticular images at different viewing angles. The transparent lenticular sheet array 6 of FIG. 1 has, on its side opposite the lenses, two respective coplaner images 3 and 5 in the form of stripes. A viewer at position 5' will see image 5 because of the focusing action of the lenticular array 6, while a viewer at position 3' will see image 3. The images 3 and 5 may be on the surface of element 1, or on the registered surface of a paper or paper board sheet, either in contact or closely spaced relative to element 1.

Formation of the multiple image article of FIG. 1 in accordance with the invention is illustrated in FIGS. 2, 3, 4 and 5.

Figure 2:
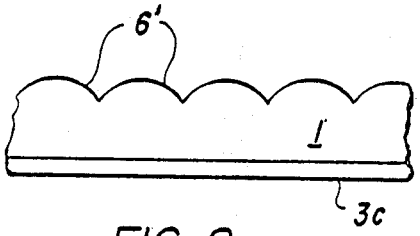
FIG. 2 is a sectional view lenticular sheet with an image coating in accordance with the invention.

FIG. 2 shows a lenticular transparent plastic sheet with a continuous image 3*c* formed of UV (ultra-violet) curable image layer. The image 3*c* may be multi-colored, line or half tone and printed by any of a variety of techniques, including silkscreening, gravure, flexo, or planographic offset.

Figure 3:
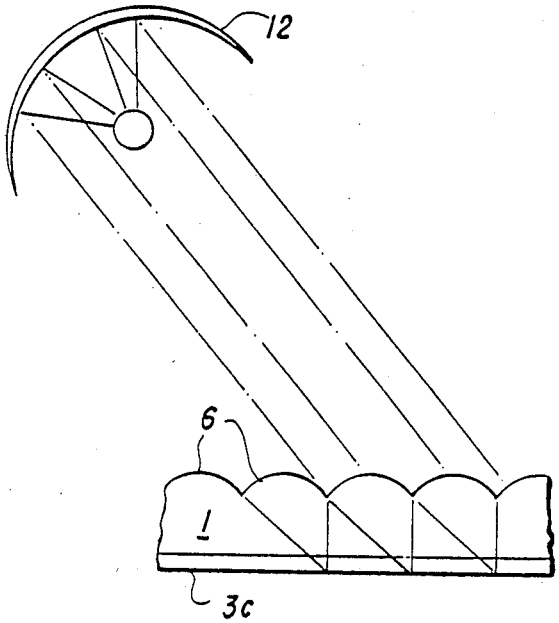
FIG. 3 is a sectional view of the sheet of FIG. 2 being irradiated at a fixed angle in relation to the sheet.
Figure 4:
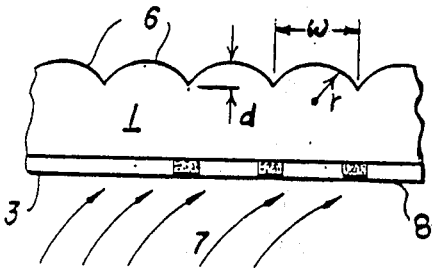
FIG. 4 is a sectional view of the sheet of FIG. 3 being rinsed after irradiation.
Figure 5:
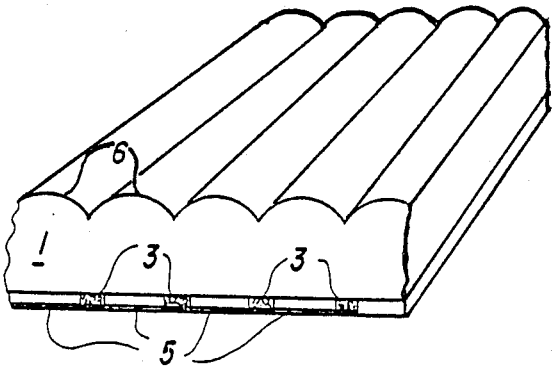
FIG. 5 is a perspective schematic of a resulting product of the invention having two images each viewable at a different angle.

The next step in the method is illustrated in FIG. 3, where the image-containing lenticular array sheet 1 is subjected to collimated radiation from an appropriate ultraviolet lamp and reflector system 12. Due to the focusing action of the lenticular array 6, the image is only cured in bands or striations. In FIG. 4 the image side 8 of the lenticular sheet 1 is subjected to a spray rinse 7, which dissolves the uncured areas of the image, leaving the image in the form of striations 3. A final, and optional step, is illustrated in FIG. 5 where a second image 5 is printed on the imaging surface 8 of the lenticular lens array 6.

In certain applications, for example packaging, it is desirable to eliminate the last step so that from one viewing angle the contents of the package may be viewed through the non-imaged region of the lenticular sheet, while from another viewing angle, the pictorial image 3 is observed.

In order to realize three-dimensional overall image the images 3 and 5 may be stereoscopic pairs. In that case, one eye positioned at 3' would see the image 3 while the other eye positioned at 5' would see image 5. For stereoscopic viewing with a typical viewing distance about 15", and an average interpupil distance of about 2.5", the angle between the viewing position 3' and 5' would be approximately 5 degrees. Hence, the geometry of images 3 and 5 would be adjusted to provide this viewing angle.

Although the figures illustrate only two different images, it is possible to produce a large number of different images, for example five, using the method of the invention. Each image is printed, exposed and then cured with UV illumination at a different angle. Furthermore, by employing a lenticular array wherein the lenticles are aligned in rows, it is possible to generate multiple images in different directions; i.e., images which vary when the article is tipped up-and-down and side-to-side. Again, the position of the UV curing lamp defines the images seen at a particular position.

In a preferred embodiment the image layer applied to the imaging surface side 8 of lenticular lens array 6 is a water soluble photo cross-linkable polymer containing a visible light absorbing pigment. Thus the lenticular lens array 6' is formed by first embossing a film 1 (preferably a polyvinylchloride film) and then printing the water soluble material on the side of the film opposite the embossed surface. The lenticular array 6' is composed of individual lenticles 6. The lenticles 6 may be of convex shape when viewed in the cross section direction. These lenticles will have an apex portion and trough or groove portion as shown in the Figures. The lenticles 6 are typically of elongated form having the aforementioned convex shape in the cross sectional view. The elongated lenticles are typically arranged in straight line patterns running along a major portion of the length or width of a side of film 1 as illustrated in FIG. 5. The lenticles 6 or at least a plurality of the lenticles are preferably aligned in rows as shown in FIG. 5. The lenticles 6 may also be arranged in circular or concentric circles or other curved patterns on film 1. The lenticles 6 may be replaced with lenses of other shapes, for example semispherical shape wherein each lens has the shape of a semispherical dome and would appear as tiny bubbles on the surface of film 1. Such lenses are also preferably arranged in rows but it is possible to obtain good visual effects even if the lenses are not in rows but rather are in scattered patterns.

The film 1 is relatively thin, preferably less than about 10 mil (0.01 inch) and typically between about 2 to 6 mil. Although the film 1 may be made from a wide variety of thermoplastic materials. Polyvinyl chloride, polyethylene terephthalate and polystryene are particularly desirable. Polyvinylchloride is preferred. The size of the individual lenticles 6 and film 1 thickness may vary but applicant has determined that the following specifications produce especially good visual effects. For a preferred thickness of about 4 mil. (0.004 inches) of film 1 each lenticle (lens) 6 as illustrated for example in FIG. 4 may have a preferred width w (groove spacing) between about 2.2 and 4 mil. (0.0022 to 0.004 inches) which corresponds to between about 250 to 454 lenticles per inch. The depth d, of each lenticle 6 may be between about 0.3 and 0.7 mil. (0.0003 to 0.0007 inches) and the radius r about 1.7 mil. (0.0017 inch). The embossing is accomplished such that the lenticles 6, as shown in FIG. 4, are applied to film 1. Each lenticle 6 is typically layed out in straight line pattern across the surface of film 1, and the lenticles 6 are preferably arranged in parallel rows. The lenticle density, i.e., the number of lenticles per inch in the present invention, is believed to be higher than that employed in prior art methods which attempt to line up printed images behind embossed surfaces. By having a high number of lenticles per inch namely higher that about 100 lenticles per inch and preferable between 200 to 600 lenticles per inch, more preferably between 250 and 450 lenticles, applicant has obtained an image of high degree of clarity. Also the present method of forming the images 5 permits use of thin film 1, typically of thickness less than about 10 mil., preferably between about 2 to 6 mil. This results in a finished lens array 6 which produces high visual clarity of the printed image 5 formed in the manner herein disclosed as well as minimizing the product cost by minimizing the amount of material employed.

The first image 3 may have a single color or may be multicolored, i.e., containing typically up to about four colors. Likewise, the second image 5 if employed, may be of one or more colors.

In the process of creating the lenticular lens array 6' and underlying image basic steps are (a) embossing the thermoplastic film 1 to obtain the aforementioned lenticular array 6'; (b) printing an image layer on the side of film 1 opposite the lenticular array 6' and drying the printed image; (c) exposing the printed image to collimated radiation from a UV light source; (d) rinsing the image to dissolve away the unexposed portions of the printed image, i.e. those portions that did not receive exposure to the UV light source and (e) drying the printed surface. The image may be printed on film 1 in step (b) by employing gravure, flexographic, screen printing or other conventional printing method. The printed image is then dried in conventional manner using convective hot air or an infrared heat source. When the UV light source is aimed at the dried printed image in step (c) it is positioned above the lenticular lens array as aforementioned and aimed at a given angle for example 30 degrees, 90 degrees, or 120 degrees. As the light source is held fixed at the given angle and as UV light passes through the lenticular lens array those portions of the underlying printed image in the focal line of the lenses become exposed. The photosensitive polymer undergoes a chemical change which causes that exposed portion of the image layer to become water insoluble and permanently adhere to film 1. The photosensitive change in the image layer which causes it to become water insoluble is broadly referred to herein as the process of curing by exposure to the collimated UV radiation. On exposure to the UV light source the photosensitive polymer contained in the image layer which undergoes a chemical change is believed to initiate some cross linking reaction as well. The net result is that the exposed portions of the printed image becomes cured, permanently affixed to film 1 and those cured portions become water insoluble. The portions of the printed image, which were not in the line of the UV light, do not become exposed and thus are simply rinsed away in the water rinsing step (d). After a water rinse is applied to rinse away the unexposed portions of the printed image, the remaining portions i.e., the cured image is exposed to hot air, infrared heat or equivalent drying to remove residual water.

A first image 3, as shown in FIG. 4, was produced by employing steps (a) through (e) as above described. After the permanent water insoluble image 3 has been produced, a second image 5 may be created in analagous manner. This is accomplished by printing a second image (step b) over image 3 and then aiming the UV light source (step c) at a different angle than was employed when producing the first image 3. Thus if image 3 was produced with UV light source aimed at an angle of 30 degrees in relation to film 1, the second image 5 may be produced for example by aiming the UV light source at an angle of 90 or 120 degrees in relation to film 1. After the second image is exposed to the UV light and the unexposed portion rinsed with water a permanent water insoluble second image 5 is produced on imaging surface 8. Now as the viewer looks down on the lenticular lens array the first image 3 will appear when the line of sight is at one angle, and the second image 5 will appear when the line of sight is changed to another angle.

It should be appreciated that either or both image 3 and image 5 may be made of different colors employing the aqueous, photosensitive ink herein. This is accomplished by printing various portions of the original image in different print stations. A differently colored portion of the image would be applied in the separate print stations. The final print would appear as multicolored.

The multicolored image would than be exposed at one time to UV light source in the manner aforementioned. This technique could be employed to produce final cured multicolored image 3 or 5.

The preferred water soluble, UV light sensitive image layer employed herein consists of three principal components: (a) a binder system, (b) a water dispersible pigment and (c) a water soluble, light sensitive diazo resin.

a. Binder System

The binder system is composed of two principal components:

(1) a water soluble polymer and (2) an aqueous dispersion.

The water soluble polymer acts as a dispersant for the pigment and as a protective colloid for the emulsion. The water soluble polymer facilitates the removal of the unexposed portions of the image layer by rinsing with water and also contributes to the rheology of the coating. Preferred water soluble polymers have been determined to be polyvinyl alcohol or hydroxyethylcellulose.

A polyvinyl alcohol (100 percent hydrolyzed) water soluble polymer for use in the present formulation is available from Eastman Kodak Co., Rochester, N.Y.

A preferred aqueous dispersion has been determined to be a modified polyvinyl acetate emulsion. A preferred polyvinyl acetate emulsion for use in the present UV curable photosensitive ink formulation is available under the trade name SYNTHEMUL synthetic resin emulsion 40507-00 from Reichhold Checicals, Inc., Emulsions Polymer Division, Dover, DE.

The modified polyvinyl acetate emulsion gives added strength to the coating and helps to hold all of the pigment in the binder matrix. The amount of binder in the formulation can be adjusted to give the best results. If too little binder is used some of the pigment particles may become free of the dispersion, and therefore not being readily washed from the film 1 during the rinsing stage. Such residual pigment particles will result in background tinting which is unacceptable since it will detract from the crisp visual appearance of the final image.

b. Water Dispersible Pigment

A wide variety of water dispersible pigments may be employed in the present formulation. The pigment is selected depending principally of the color desired. Most conventional pigments employed in aqueous based inks should be compatible with the binder system described herein. A proper pigment depending on the desired color may be selected from the Hiltasperse aqueous pigment series from the Hilton Davis Company, a subsidiary of Sterling Drug, Inc., Cincinnati, OH.

The following aqueous pigment dispersions available from the Hiltasperse series may be conveniently employed in the present formulation: Hiltasperse Yellow 2G (arylide yellow family); Hiltasperse Red 2R (pyrazolone red family); Hiltasperse White (titanium dioxide family); Hiltasperse Black K (carbon black); Hiltasperse Blue 3G (phthalocyanine blue family).

c. UV Photosensitive Compound

The UV light sensitive compound for the present water soluble image layer is preferably a diazo resin. The diazo resin gives the ink coating its photosensitive properties. As aforementioned the photosensitive polymer such as the diazo resin undergoes a chemical change when exposed to ultra violet radiation. The chemical change on curing as it has been referred to herein causes the image layer to become water insoluble in those regions where it has been exposed to the UV radiation. The chemical change or curing which the photosensitive polymer undergoes upon exposure to UV radiation also promotes greater adhesion of the image layer to film 1 particularly if the film is polyvinylchloride. A preferred water soluble photosensitive polymer is the diazo resin polymethylene para diazo diphenylamine sulfate salt. This preferred diazo resin is available under the trade name Silk Screen Diazo 7-LZ from Molecular Rearrangements, Inc., of Newton, N.J. Half zinc, full zinc salt of polymethylene para-diazo diphenylene may also be employed. Other photosensitive polymers may be substituted for the preferred resin which is the polymethylene para-diazo diphylamine sulfate. Photosensitive compounds employed in the so called "tanning reaction" can generally be used as the photosensitive component in the present formulation. These compounds include known photosensitive chromic-acid salts, certain azides, and a variety of high molecular weight diazonium salts which are not themselves condensation products of 4-diazodiphenylamine (and its derivatives).

d. Auxilary Components

Other components such as defoaming agents, additional dispersing agents or stabilizing agents could optionally be added to the image layer formulation. Applicants tests do not reveal that additional components are absolutely required. However, it has been found desirable to add a stabilizing agent which preferably is a weak, water soluble organic acid. It is desirable to add the acid to the formulation to stabilize the diazo compound and to prevent it from under going a dark reaction. It also acts as a preservative in that it lengthens the useful life of the image layer once it has been prepared and allows the coated image sample to be stored for days before being exposed to UV light. A preferred weak organic acid which has proved to stabilize the diazo resin and increase the shelf life of the image layer is adipic acid. However, other weak acids can be employed such as citric acid, tartaric acid or water soluble salts such as zinc chloride.

A preferred UV light sensitive formulation having the aforementioned properties is provided in Table I:

TABLE I

| UV Light Sensitive Image Layer: | Percent by Weight |
|---|---|
| a. Binder System | |
| (i) Aqueous Dispersion | |
| (polyvinyl acetate emulsion, e.g. Synthemul Synthetic Emulsion 40507-00) | 20.0 |
| (ii) Water Soluble Polymer | |
| (polyvinyl alcohol, 100% hydrolyzed) | 2.7 |

TABLE I-continued

| UV Light Sensitive Image Layer: | Percent by Weight |
|---|---|
| b. Pigment | |
| Aqueous Pigment Dispersion (e.g. Hiltasperse acqueous pigment dispersion) (e.g., Hiltasperse Red 2R) | 20.0 |
| c. Water Soluble U.V. Light Sensitive Component | |
| Polymethyl para diazo diphenylamine sulfate salt (e.g., Silk Screen diazo 7-LZ salt) | 1.2 |
| d. Stabilizing Agent | |
| Adipic Acid | 0.4 |
| e. Water | 55.7 |
| | 100.0 |

In the preferred composition for the UV light sensitive formulation as shown in Table I on a water free basis, has the following composition, percent by weight: Polyvinyl acetate (solids) 51.8%, pigment 25.9%, polyvinyl-alcohol 14.0%,; UV light sensitive diazo resin 6.29%, adipic acid 2.1%. Thus, the foregoing composition is the composition of the ink formulation shown in Table I after it has been applied to film 1 and drained to dry off the water contained therein.

Details for carrying out this invention are illustrated in connection with the following non-limiting examples:

EXAMPLE 1

A process color image was gravure printed onto the planor surface of a 0.004 inch thick polyvinyl chloride film whose opposite surface was embossed to provide a lenticular surface with a density of 400 lenticles per inch. The ink had the composition shown in Table I. The image was cured employing a mercury vapor light source operating at a power density of 200 watts per inch and housed in a cylindrical reflector with an parabolic cross-section as shown in FIG. 3. The lamp was positioned at a angle of 30 degrees to the normal. After curing, the portions of the image that were uncured were rinsed away using a water wash spray to remove uncured portions of image. A high quality image was obtained when the *lenticular plate was viewed from the position where the UV lamp was located during operation. At other angles the lenticular sheet was sufficiently transparent so that the viewer could clearly make out text and printed designs on any underlying substrate place against the lenticular sheet.

EXAMPLE 2

Example 1 was repeated with an additional step of printing a second process-color image over the imaging surface of the lenticular transparent plastic sheet. This image was printed using essentially the same composition shown in Table I. The second image was cured using UV light focused at a different angle with the lenticular sheet than was used in curing the first image. Uncured portions of the second image were rinsed away with water. The first image became clearly visible as the lenticular sheet was tilted to the first above referenced angle (30 degrees to normal) and the second image became clearly visible as the lenticular sheet was tilted to the angle at which the second image was cured. Both images were visible as high quality, high contrast images.

EXAMPLE 3

Example 1 was repeated and the lenticular sheet placed in a vacuum chamber where the imaging surface was vacuum metallized with aluminum. After removal from the vacuum chamber, a highly reflective surface was visible at one viewing angle while the pictorial image was observed at a different viewing angle.

EXAMPLE 4

Stereo separation pairs were printed on a lenticular sheet. The first stereo pair was printed with UV photosensitive ink having the composition shown in Table I. The image was cured as in Example 1 and the uncured portion of the image removed. The second stereo pair was then printed also using the photosensitive image layer formulation shown in Table I. The second image was coated onto the imaging surface of the sheet. This image was cured by focusing the UV light onto the lenticular array at an angle approximately between 4 to 12 degrees apart from the angle of UV light at which the first image was cured. A high quality three dimensional image was observed when this lenticular sheet was viewed at a distance of approximately 16".

EXAMPLE 5

A first image was printed on the imaging surface of a lenticular sheet using the photosensitive layer of composition shown in Table I. A well-collimated ultraviolet source was positioned at an angle of 60 degrees to the normal to cure those portions of the ink onto which the ultraviolet light focused. The uncured portions of the image were then rinsed away with water. A second image was printed and subsequently cured with the UV source of an angle of 30 degrees from normal. Again the uncured portions of the image were water rinsed. A third exposure in a position normal to the plane of the lenticular array was followed by again repeating the process at angles of −30 degrees and −60 degrees. The result was multiple imaging with five different images. Each image became visible when the lenticular sheet was viewed at the same angle, respectively, that was used to cure that image with the UV light source.

While various aspects of the invention have been set forth by the drawings and specifications, it is to be understood that the foregoing detailed description is for illustration only and that various changes, as well as the substitution of equivalent constituents shown and described may be made without departing from the spirit and scope of the invention as set forth in the appended claims.

What is claimed is:

1. An imaging method which comprises the steps of:

(a) embossing a plastic film to produce an array of lenticles on said film, (b) printing an image with a visible light absorbing UV sensitive imaging layer on the side of the film opposite the array of lenticles;

(c) exposing portions of the printed image to collimated ultraviolet radiation by passing said ultraviolet radiation through said lenticles, (d) rinsing the imaging layer with an aqueous media thereby rinsing away said unexposed portions of the image, resulting in a film product whereby an image can be made to appear and disappear by viewing the lenticular side of the film and changing the viewing angle in relation to the plane of the film.

2. A method as in claim 1 wherein said imaging layer contains a photosensitive component which undergoes a chemical change upon exposure to ultraviolet light thereby making said exposed portions of the image water insoluble.

3. A method as in claim 2 wherein the photosensitive component is a water soluble diazo resin and dyes or other coloring material are not added to be absorbed into the imaging layer subsequent to step (b).

4. A method as in claim 1 wherein at least a portion of the lenticles are arranged in rows and wherein the density of said portion is between about 100 lenticles per inch and 600 lenticles per inch.

5. A method as in claim 1 wherein the thickness of the plastic film is less than about 10 mil.

6. A method as in claim 1 further comprising the step:

(e) printing a second image with a light sensitive imaging layer on the side of the film opposite the array of lenticles.

7. A method as in claim 6 further comprising the steps:

(f) exposing portions of the second printed image to ultra violet radiation by passing said ultraviolet light through said lenticles, (g) rinsing the image with an aqueous media thereby rinsing away said unexposed portions of the image resulting in a film product whereby a first image appears when the film is viewed from the lenticle side of the film at one angle and a second image appears when the film is viewed from the lenticle side of the film at a second angle.

8. A method as in claim 7 wherein the angle at which the ultraviolet light makes with the plane of said film is different in step (f) from that of step (c).

9. A method as in claim 1 wherein the aqueous media is water.

10. A method as in claim 1 wherein at least a portion of the lenticles are arranged in rows and wherein the density of said portion is between about 200 to 600 lenticles per inch.

* * * * *